United States Patent [19]

Dillon

[11] Patent Number: 4,981,213

[45] Date of Patent: Jan. 1, 1991

[54] PACKAGE HAVING AN IMPROVED OPENING FEATURE

[75] Inventor: Ralph L. Dillon, Fremont Township, Lake County, Ill.

[73] Assignee: G. D. Searle & Co., Chicago, Ill.

[21] Appl. No.: 456,928

[22] Filed: Dec. 20, 1989

[51] Int. Cl.[5] ..... B65D 73/00

[52] U.S. Cl. ..... 206/469; 206/462; 206/484; 206/604; 206/629; 206/630

[58] Field of Search ..... 206/461, 469, 620, 627, 206/629, 630, 634, 484, 466, 462, 463, 632, 604, 622

[56] References Cited

U.S. PATENT DOCUMENTS

| | | | |
|---|---|---|---|
| 2,125,318 | 8/1938 | Salfisberg | 206/629 X |
| 2,139,040 | 12/1938 | Salfisberg | 206/466 |
| 2,329,360 | 9/1943 | Salfisberg | 206/484 |
| 2,658,613 | 11/1953 | Valckening | 206/632 X |
| 3,173,540 | 3/1965 | Lapides | 206/462 X |
| 3,183,100 | 5/1965 | Bonini | 206/462 |
| 3,301,395 | 1/1967 | Swerey | 206/469 |
| 3,334,804 | 8/1967 | Watts, Jr. | 206/620 |
| 3,608,815 | 9/1971 | Bunch | 206/604 |
| 3,695,417 | 10/1972 | Stoker, Jr. | 206/462 X |

FOREIGN PATENT DOCUMENTS

| | | | |
|---|---|---|---|
| 2328177 | 12/1974 | Fed. Rep. of Germany | 206/462 |
| 1407597 | 9/1975 | United Kingdom | 206/463 |

*Primary Examiner*—Bryon P. Gehman

*Attorney, Agent, or Firm*—Gildo E. Fato; Paul D. Matukaitis

[57] ABSTRACT

An easily opened package is provided, formed of a substantially rigid, foldable sheet, such as cardboard, and having an opening on one side of the sheet. A plastic film is sealed about the opening and is stretchable to form a pouch for receiving an item to be stored in the package. To form the package, the plastic film is heated and stretched about the item and the cardboard sheet is folded over and sealed together. Prior to forming the package, a pair of opposing cuts are formed in the edges of the film, the cuts facilitating tearing of the film when it is desired to open the package. To further facilitate opening, indicia can be placed on the edges of the cardboard sheet to indicate the point at which tearing is easiest, or notches can be cut in one side of the sheet.

6 Claims, 1 Drawing Sheet

FIG. 1.
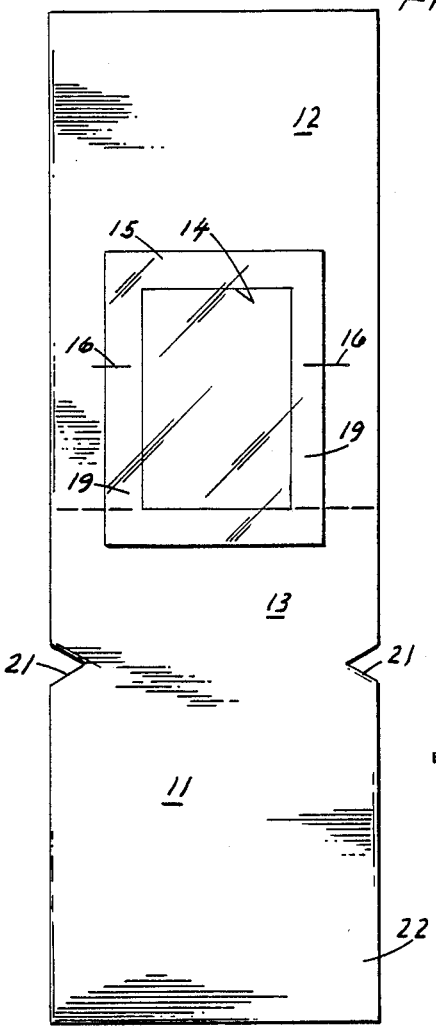
FIG. 2.
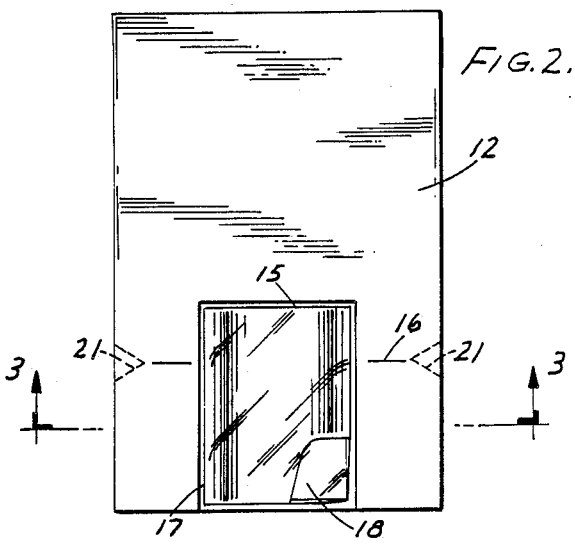
FIG. 3.
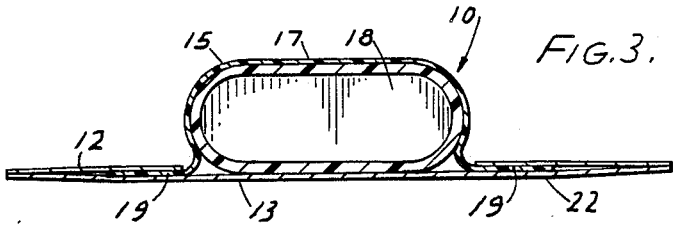
FIG. 4.
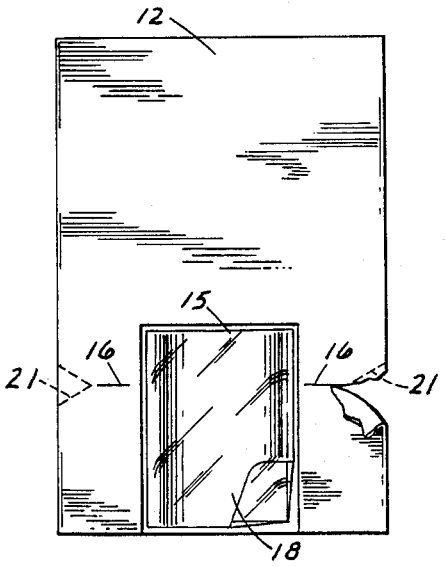
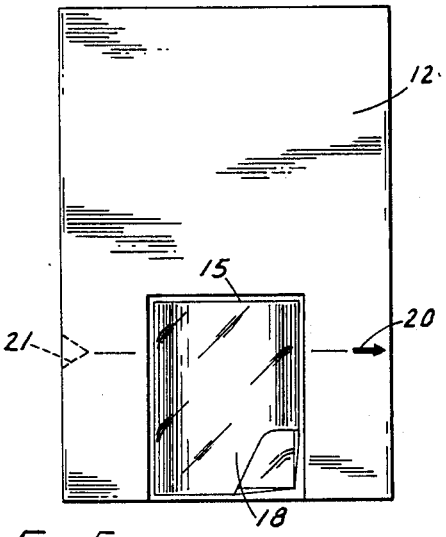
FIG. 5.

PACKAGE HAVING AN IMPROVED OPENING FEATURE

BACKGROUND OF THE INVENTION

Conventional blister packs are commonly used in the packaging of various products. Such packages are desirable in that the product or item is visible to the consumer and are substantially air- and moisture-tight due to the sealing of the plastic film which is used to form the blister to the package base or backing. The problem with this type of packaging is that the blister pack is difficult to open when it is desired to remove the product or item from the package.

U.S. Pat. No. 2,105,367 discloses a flexible wrapper including preformed weakened zones to facilitate opening the package. The weakened zones comprise notches and a tab to pull a portion of the wrapper in a fixed direction to tear open the package.

U.S. Pat. No. 3,078,986 describes a blister having a polyethylene cover sheet secured to the blister with a corner cut away to facilitate grasping and removal of the lid.

U.S. Pat. No. 4,398,634 employs slits or cuts as indicia to direct the user to the proper position for opening of the package for removal of individual units.

U. S Pat. No. 4,781,294 describes a tear-oriented package formed of a pair of wall members sealed together, at least one of the wall members being formed of foamed polypropylene material to facilitate the tearing of the one wall member to open the package in a predetermined direction while resisting the opening of the package in other directions. An H-shaped die cut is formed in the foamed polypropylene member over which a tab is placed to facilitate opening of the package.

While these designs facilitate opening of blister-type packages, there is a need for an improved opening feature which is a simple to use and economical to manufacture.

SUMMARY OF THE INVENTION

An easily opened package is provided formed of a substantially rigid pair of sheets, one of the sheets having an opening therein. Preferably a foldable sheet of cardboard is used. A plastic film is sealed about the opening in one side of the sheet and is stretchable to form a pouch for receiving an item to be stored in the package. To form the package, the plastic film is heated and stretched about the item and the cardboard sheet is folded over and sealed together. Prior to forming the package, a pair of opposing cuts are formed in the edges of the film, the cuts facilitating tearing of the film when it is desired to open the package. To further facilitate opening, indicia can be placed on the edges of the cardboard sheet to indicate the point at which tearing is easiest, or notches can be cut in one side of the sheet.

BRIEF DESCRIPTION OF THE DRAWINGS

In the drawings:

FIG. 1 is a top plan view showing the foldable cardboard base used in forming the package, one portion of the base including an opening for receiving the plastic film;

FIG. 2 is a top plan view of the formed package illustrating the notches formed in the base for opening of the package;

FIG. 3 is a front elevational view of the formed package having an item stored therein, as viewed along the line 3—3 in FIG. 2;

FIG. 4 is a top plan view illustrating opening of the package; and

FIG. 5 is a top plan view illustrating an alternative indicia for opening of the package.

DETAILED DESCRIPTION

Referring to the drawings, FIG. 1 illustrates a preferred form of the package (10)and comprises a substantially rigid foldable cardboard sheet (11) having a first (12) and second (13) co extensive portion. One of the portions (12) has an opening (14) therein for receiving a plastic film (15) which is stretchable when heated to form a pouch (17) for receiving an item or product (18). Prior to forming the package (10), a pair of opposing cuts (16) are formed in the edges (19) of the film (15), the cuts (16) facilitating tearing of the film (15) when it is desired to open the package (10). To further facilitate opening of the package (10), indicia (20) can be placed in the opposing portion (13) comprising the base (22) of the package (10) to indicate the point at which tearing is easiest, or notches (21) can be formed in at least one side of the sheet (12).

In use, to open the package (10) the package (10) is grasped between the fingers at the point indicated by the indicia (20) or the notches (21) and pressure is applied to tear open the package (10). The cuts (16) in the plastic film (15) greatly facilitate tearing of the film (15) to thereby allow opening of the package (10). Tearing of the cardboard base (22) of the package (10) can be begun at any point, even if no indicia (20) or notches (21) are formed therein as the tear will naturally seek the cut (16) in the film (15) to thereby facilitate opening of the package (10). The package (10) can be formed using conventional packaging equipment.

What is claimed is:

1. A stretch pack for forming a package to receive and retain an item, said stretch pack comprising:
   - a substantially rigid, foldable sheet foldable to form two opposing portions, a first one of said portions including an opening therein;
   - a plastic film including edges and sealed about said opening along said edges and being stretchable to form a pouch to receive said item;
   - the other of said portions being solid and foldable about the first portion and sealable therewith to thereby form a compartment with said stretchable film when folded and sealed together for receiving said item;
   - said plastic film having a pair of opposing cuts therein, positioned along the edges thereof to thereby facilitate opening of the package when sealed.

2. The stretch pack of claim 1 wherein the other of said portions includes indicia in alignment with the cuts in the plastic film when the two opposing portions are folded together to thereby indicate the point at which tearing of the package is easiest.

3. The stretch pack of claim 1 wherein the other of said portions includes at least one notch in alignment with the cuts in the plastic film when the two opposing portions of the foldable sheet are folded together to thereby further facilitate opening of the package.

4. A package for receiving and storing an item therein, said package comprising:

a pair of opposing, substantially rigid sheets, a first one of said sheets having an opening therein;

a plastic film including edges and sealed about said opening along said edges and forming a pouch to receive said item;

the other of said sheets being sealed to the first one of said sheets to thereby form a compartment with said pouch for the item;

the plastic film having opposing cuts therein, positioned along the edges thereof, to thereby facilitate opening of the package, said plastic film being sealed between the pair of opposing substantially rigid sheets whereby the edges of the plastic film and the opposing cuts therein are covered by the opposing sheets.

5. The package of claim 4 wherein one of said sheets includes indicia in alignment with the cuts in the plastic film to indicate the point at which tearing is the easiest.

6. The package of claim 4 wherein the other of said sheets includes at least one notch in alignment with the cuts in the plastic film to thereby further facilitate opening of the package.

* * * * *